United States Patent [19]

Stevens

[11] 4,411,432

[45] Oct. 25, 1983

[54] TRAVEL GAME

[76] Inventor: Richard L. Stevens, 301 Harrington, Gower, Mo. 64454

[21] Appl. No.: 291,566

[22] Filed: Aug. 10, 1981

[51] Int. Cl.[3] ..... A63F 3/00

[52] U.S. Cl. ..... 273/251

[58] Field of Search ..... 273/243, 248, 249, 251, 273/252, 254, 256

[56] References Cited

U.S. PATENT DOCUMENTS

| | | | |
|---|---|---|---|
| 1,451,511 | 8/1920 | Jones | 273/252 |
| 3,787,056 | 1/1974 | Hellmann . | |
| 3,883,142 | 5/1975 | Spohn | 273/251 |
| 4,052,071 | 10/1977 | Siegfried | 273/254 |
| 4,211,419 | 7/1980 | Larsen | 273/248 |
| 4,283,059 | 8/1981 | Beeder | 273/254 |

FOREIGN PATENT DOCUMENTS

| | | | |
|---|---|---|---|
| 1816885 | 8/1969 | Fed. Rep. of Germany | 273/257 |
| 2280410 | 2/1976 | France | 273/254 |
| 1548049 | 7/1979 | United Kingdom | 273/256 |

*Primary Examiner*—Richard C. Pinkham
*Assistant Examiner*—Scott Brown
*Attorney, Agent, or Firm*—Senniger, Powers, Leavitt and Roedel

[57] ABSTRACT

In a travel game for two or more players, a game board displays a geographical area with a plurality of locations linked by travel routes marked with travel distances. Each player has a position piece for moving from a designated origin along routes he chooses with the object being the first to arrive at a designated destination. A plurality of tokens each bearing a number are obtained by the players by chance. Each player combines his tokens to form combination numbers equal to the travel distances of his chosen routes and expends the tokens for the right to travel those routes. Each player has a board piece which he may place on the board on a route of his choice to indicate that passage along that route is obstructed.

10 Claims, 2 Drawing Figures

MIA
15
11
301
9
7
5
JAX
551
652
612
241
375
132
TLH
77
ATL
122
BHM
148
MEM
735
571
13
MSY
602
522
401
271
HOU
65
7
3
5
2
9
3
6
63

TRAVEL GAME

BACKGROUND OF THE INVENTION

This invention relates to board games, and more particularly to board games dealing with travel, such as air travel games.

Reference may be made to U.S. Pat. Nos. 1,451,511, 3,773,326, 3,787,056 and 4,049,276 for examples of prior board games concerning air travel.

SUMMARY OF THE INVENTION

Among the several objects of this invention may be noted the provision of a novel board game concerning travel; the provision of such a game particularly relating to air travel; the provision of such a game which realistically simulates occurrences involved in travel so as to be useful as a learning aid; and the provision of such a game which is not based entirely on chance, but requires some strategic skills.

Generally, the invention involves a travel game of skill and chance for at least two players comprising a game board displaying a geographical area with a plurality of locations linked by travel routes, each route being marked with the travel distance between the two locations linked by the route. Position pieces, one for each player, representing travel vehicles, are moved along the travel routes beginning at a designated location of origin and passing from location to location to a designated location of destination, the object of the game being to choose a path along the travel routes so as to be the first to arrive at the location of destination. Tokens each bearing at least one number are obtained by the players by chance. Each player combines his tokens in groups to form combination numbers equal to the travel distances marked on the routes of his chosen path and expends the groups of tokens for the right to move his position piece along those routes.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
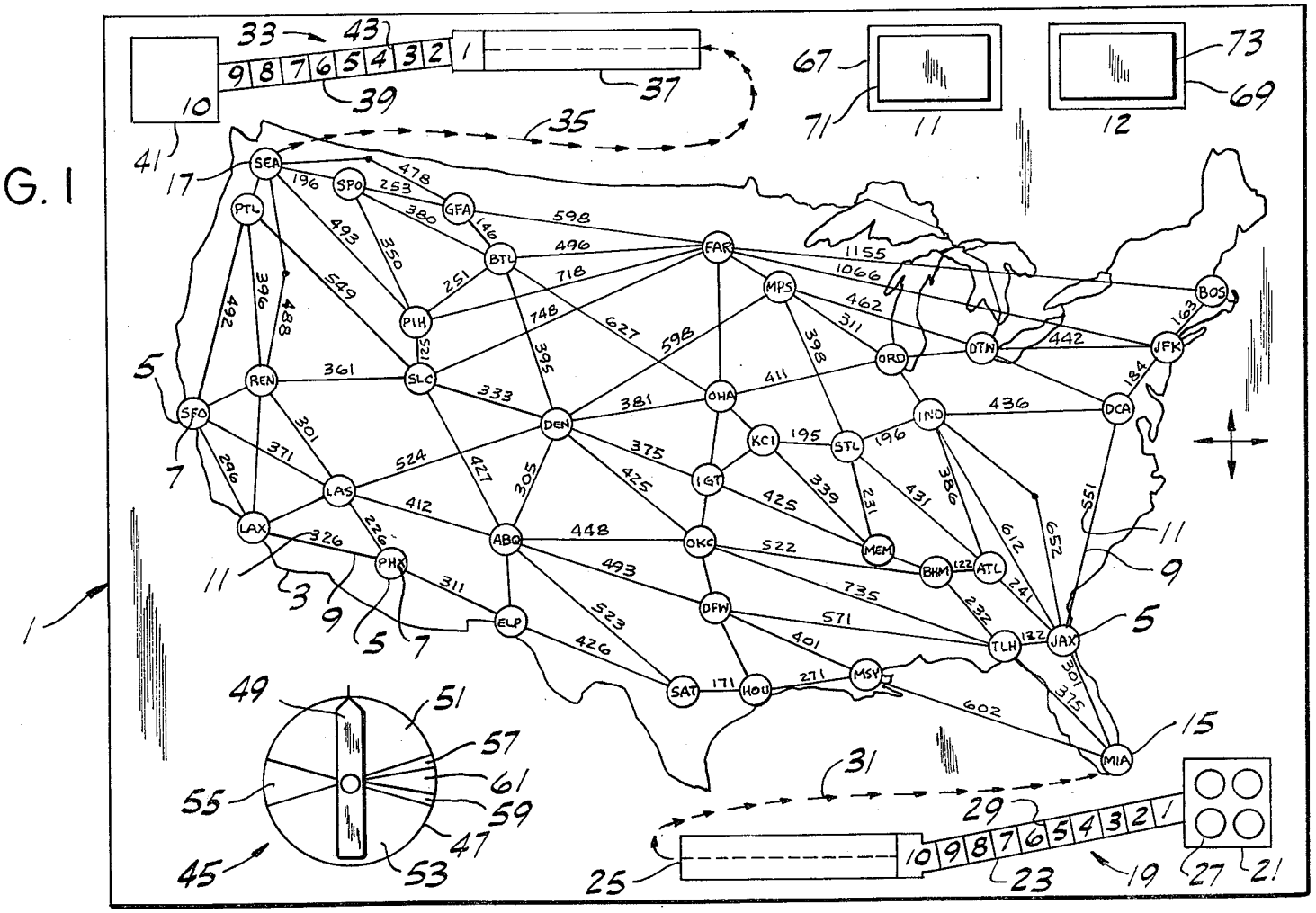
FIG. 1 is a plan view of a game board of this invention.
Figure 2:
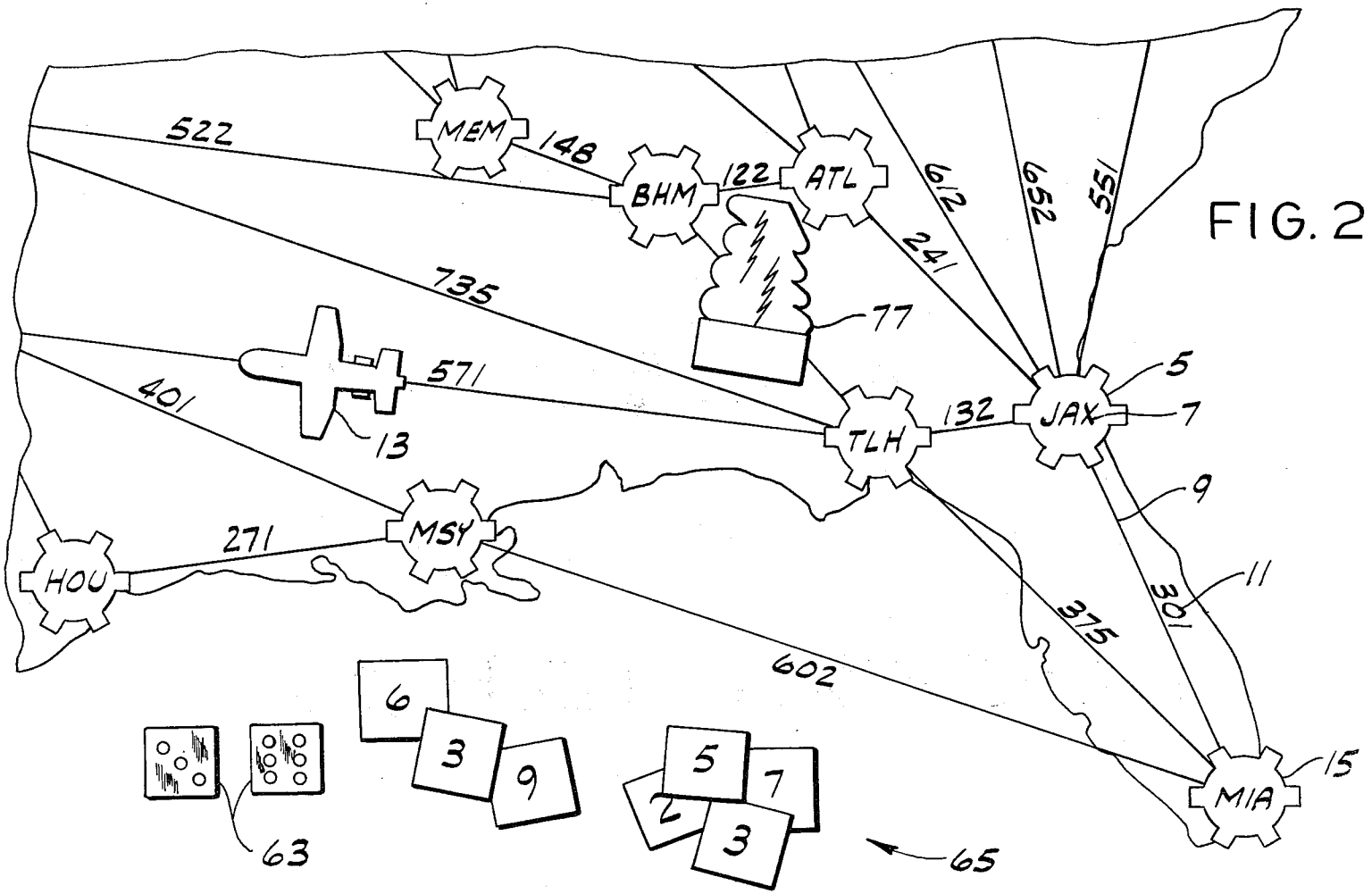
FIG. 2 is an enlargement of a portion of FIG. 1 showing position pieces, board pieces, dice and numbered tokens.

Referring to FIG. 1 of the drawings, there is indicated generally at 1 a game board displaying a geographical area 3 defined by the border of the contiguous forty-eight states of the United States of America. A plurality of locations corresponding to major cities with airports are indicated by generally circular markers 5. The markers include the standard three-letter abbreviations for the airports of the cities. Adjacent cities are linked by lines 9 corresponding to air travel routes between the cities. Each route 9 is marked with the air travel distance 11 between the two cities linked by the route. For example, as shown in FIG. 2, the distance from Jacksonville, Florida (JAX) to Atlanta, Georgia (ATL) is 241 miles.

The game is provided with a plurality of position pieces representing air travel vehicles, such as miniature airplanes 13. One airplane is provided for each player for moving along travel routes 9 beginning at a designated location of origin, which in this embodiment is the Miami, Florida (MIA) airport 15, and passing from one location 5 to the next location of destination 17, which in this embodiment is the Seattle, Washington (SEA) airport. The object of the game is to choose a path along travel routes 9 so as to be the first to arrive at the location of destination 17.

In addition to the geographic area of the U.S.A., game board 1 displays the representation of an airport, indicated generally at 19, adjacent to the MIA location 15. As shown, the airport includes a terminal ramp 21, taxiway 23, and runway 25. The terminal ramp 21 has four circular areas 27 where airplanes 13 are placed at the start of the game and leads to taxiway 23 which is divided into a plurality of spaces 29 (e.g., 10 spaces) for movement of the airplanes 13 along the taxiway. The spaces are numbered from one to ten beginning from the terminal ramp. The taxiway leads to runway 25, and arrows 31 leading from the runway to MIA location 15 indicate that the airplane should be placed on the MIA location after takeoff from the runway.

A similar airport representation generally designated 33 is displayed on game board 1 adjacent to SEA location 17, including arrows 35 from the SEA location to a runway 37, which leads to a taxiway 39 ending in a terminal ramp 41. Airplanes 13 are moved along this taxiway after arriving at the SEA location for passage to the terminal ramp, which constitutes the finish point of the travel game. The taxiway is divided into a plurality of spaces 43 numbered from one through nine beginning at the runway. The terminal ramp 41 is numbered ten.

Chance means indicated generally at 45 on the game board governs entry of airplanes 13 onto taxiways 23 and 39 and onto runways 25 and 37. This means 45 comprises a dial spinner with a dial 47 and a spinner 49, the dial being divided into a plurality of discrete wedge-shaped areas 51–61, each having a taxiing or landing instruction associated therewith. These discrete areas are color-coded according to conventional light gun signals commonly used by air traffic controllers in the absence of radio communication. The following table describes the dial and associated code.

| Numerical Designation for Dial Area | Color | Meaning for Aircraft on Ground | Meaning for Aircraft in Flight |
|---|---|---|---|
| 51 | Steady green | Cleared for takeoff | Cleared to land |
| 53 | Flashing green | Cleared for taxi | Wait; land when steady green signal is received (no action permitted) |
| 55 | Steady red | Stop (no action permitted) | Continue circling (no action permitted) |
| 57 | Flashing red | Taxi clear of runway (no action permitted) | Airport unsafe, do not land (no action permitted) |
| 59 | Flashing | Return to terminal | Not applicable |

-continued

| Numerical Designation for Dial Area | Color | Meaning for Aircraft on Ground | Meaning for Aircraft in Flight |
|---|---|---|---|
| | white | | |
| 61 | Alternating red and green | Caution (no action permitted) | Caution (no action permitted) |

A pair of dice 63 (FIG. 2) is used for governing play, including movement of airplanes 13 along the taxiways. Of course, other chance number indicator means may be substituted.

The game includes a plurality of tokens 65 (see FIG. 2) each bearing a single-digit number, zero through nine. These tokens are obtained by the players at the beginning of the game and by chance thereafter by rolling dice 63 to acquire more tokens as the others are expended. Each player combines his tokens in groups to form three-digit or four-digit combination numbers equal to the travel distances 11 on his chosen routes 9. He expends the groups of tokens for the right to move his airplane 13 along those routes. Tokens not held by any of the players are kept in a kitty (not shown).

The game board has a pair of rectangles 67 and 69 in its upper right corner for indicating where two sets of instruction cards 71 and 73 respectively are to be placed on the board. Rectangle 67 has the numeral 11 printed beneath it and rectangle 69 has the numeral 12 beneath it. These cards, together with the dice 63 and tokens 65, constitute chance means for use by the players in turn for governing movement of the airplanes from location to location along the players' chosen paths. The cards are selected by the players upon the indication of a sum on the dice of 11 or 12. A player rolling 11 with the dice must draw from cards 71 on rectangle 67; if he rolls 12 he draws from cards 73 on rectangle 69. Corresponding rectangles and sets of cards may be of the same color (e.g., green, red) for ease in setting up the game before play begins. The following are examples of the instructions on cards 71, which exact a penalty:

1. THUNDERSTORMS—you are entering an area of thunderstorms requiring deviations. The player on your left gets two turns.
2. C.A.T.—you are encountering clear air turbulence. You lose one turn and one token.
3. RAINY SKIES—give up one token of your choice.
4. UNFAVORABLE HEADWINDS—you are encountering strong headwinds. You lose one turn.
5. HEAVY AIR TRAFFIC—give one token to the player on your left.
6. ICING—you are encountering severe icing in clouds. You lose one turn.

The following are examples of the instructions on cards 73, which are favorable to a player:

1. LIGHT LOAD—your aircraft is well below maximum gross weight today. Take two turns.
2. SMOOTH AIR—take one token of your choice.
3. COLD TEMPERATURE—temperatures aloft today are below normal thus giving higher air speed. Take a token of your choice.
4. LIGHT AIR TRAFFIC—air traffic is very light today. Take one token from the player on your left.
5. TAILWIND ADVANTAGE—you are encountering favorable tailwinds. You may proceed to the next city on your route.
6. CLEAR SKIES—take one token of your choice.

Finally, a plurality of board pieces 77 (FIG. 2) shaped to represent thunderstorm clouds are provided, one for each player. These may be placed by a player on the board on a route 11 of his choice at any time of his choice during the game to indicate that passage along the route is obstructed and thus not permitted.

Playing the Game

The object of the game is to be the first to arrive at terminal 41 for the SEA location 17. All players must begin on one of the circular areas 27 at terminal ramp 21 for the MIA location 15. Each player begins by selecting an airplane 13 and one thunderstorm board piece 77, and receives four tokens, with numbers 0, 7, 8 and 9. Each player first rolls the dice, with the player having the highest sum being permitted the first turn. Play then proceeds clockwise around the board.

Play begins with the players spinning spinner 49 in turn and following the color-coded instructions on the dial. When a player receives a flashing green instruction (i.e., when the spinner lands on area 53), he may roll dice 63 and move his airplane 13 down the taxiway the number of spaces equal to the sum of the dice roll. In the event that a player's airplane would land on a taxiway slot occupied by another airplane, he must forfeit that turn. When a player's aircraft has advanced to runway 25, he spins spinner 49 (once per turn) until he receives a steady green instruction indicating he is cleared for takeoff. Then he places his aircraft on MIA location 15.

In order to proceed along air travel routes between origin location MIA 15 and destination location SEA 17, each player combines his tokens 65 in groups of three (or four) to form three-digit (or four-digit) combination numbers, each token representing one digit. He expends his groups of tokens for the right to move his airplane 13 along the travel routes 9. The group of tokens expended for the right to travel a particular route must equal the travel distance 11 of the particular route. Example: to move an airplane from MIA to TLH (Tallahasee, Florida) a player must have tokens bearing 3, 7 and 5, since the marked distance from MIA to TLH is 375 miles. Once expended the tokens are returned to the kitty from whence they may be drawn by all of the players.

To acquire tokens after the start of the game, each player rolls the dice 63 at the start of his respective turn. When a player rolls the dice, he may use the sum of the dice to acquire a token equal to that number, or use the numbers separately to acquire two different tokens. Example: if a player rolls 4 and 5 on the dice, he may acquire a 9 token, or a 4 token and a 5 token. However, if a player rolls an 11 or 12 on the dice, he must select from the sets of instruction cards 71 or 73, respectively. After rolling the dice and acquiring tokens or receiving an instruction card, the player completes his turn by following the instruction, or if he does not receive a card, by expending a group of tokens to move his airplane 13 to the next location 5 on his chosen path, assuming he has tokens combinable to form the distance to the location. At the completion of his turn, the player is not permitted to have more than seven tokens in his possession. If he has more, he must return the extra token or tokens of his choice to the kitty. If a player rolls doubles on the dice, he may take a second turn.

At any time during his turn, a player can obstruct a route 9 of his choice by placing his thunderstorm board piece 77 on the route. However, only one route to a city may be blocked by thunderstorm pieces and once a thunderstorm piece is placed on a route it cannot be moved. The routes between PTL (Portland, Oregon) and SEA 17 and between SPO (Spokane, Washington) and SEA may not be blocked by thunderstorm pieces.

Once a player's airplane has reached SEA location 17 on his next turn he spins spinner 49 (once per turn) until the spinner lands on the steady green color-coded area, meaning he is cleared to land. Then he may follow arrows 35 to the runway 37. On subsequent turns he may spin spinner 49 (once per turn) until the spinner stops on the flashing green area 53 meaning he is cleared to taxi. On the following turn the player may roll the dice and proceed the number of spaces 43 indicated by either one or both of the dice. Several turns may be required to reach terminal ramp 41, that is space 10. The player must enter the terminal ramp on an exact roll. Example: with his airplane on space 4, a player must roll six in order to stop on space 10 (terminal ramp 41) and win the game. Again, no two airplanes may occupy the same taxiway space.

At the players' option, play may continue after the first airplane reaches the terminal ramp to determine second, third, etc. places.

This travel game will be enjoyed by children and adults. Since it realistically represents and simulates actual occurrences in air travel, such as delays due to thunderstorms and the requirements of control tower clearance fpr taxiing, takeoff, and landing, it can be a valuable learning aid, particularly for children. Moreover, because the game is not based entirely on chance, but requires some strategic skills, it is a stimulating game.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A travel game of skill and chance for at least two players comprising:

a game board displaying a geographical area with a plurality of locations linked by travel routes, each route being marked with a travel distance between the two locations linked by the route;

a plurality of position pieces, one for each player, representing travel vehicles for moving along the travel routes beginning at a designated location of origin and passing from location to location to a designated location of destination, the object of the game being to choose a path along the travel routes so as to be the first to arrive at the location of destination;

a plurality of mileage tokens each bearing only a single-digit number and being obtained by the players by chance, each player combining his single-digit number tokens in groups to form combination numbers equal to the travel distances marked on the routes of his chosen path and expending the groups of tokens for the right to move his position piece along those routes; and chance number indicator means for use by the players in turn for acquiring the numbered tokens.

2. A travel game as set forth in claim 1 wherein the chance number indicator means comprises a pair of dice.

3. A travel game as set forth in claim 1 further comprising a set of instruction cards selectable by the players upon the indication of a predetermined number by the chance number indicator means.

4. A travel game as set forth in claim 1 further comprising a board piece for placement by a player on the board on a route of his choice to indicate that passage along that route is obstructed and thus not permitted, said board piece being a weather hazard.

5. A travel game as set forth in claim 4 wherein the travel routes represent air travel routes and the board piece is shaped to represent a thunderstorm cloud.

6. A travel game as set forth in claim 1 wherein the travel routes represent air travel routes and the position pieces are miniature airplanes.

7. A travel game as set forth in claim 1 wherein the travel routes represent air travel routes and the game board further displays a representation of an airport taxiway for movement of the position pieces therealong prior to departing from the designated location of origin, said game further comprising chance means governing entry of the position pieces onto the taxiway.

8. A travel game as set forth in claim 7 wherein the game board further displays a representation of an airport taxiway and terminal for movement of the position pieces along the taxiway after arriving at the designated location of destination for passage of the position pieces to the airport terminal which constitutes the finish point of the travel game, entry of the position pieces onto the taxiway being governed by said chance means.

9. A travel game as set forth in claim 8 wherein each taxiway is divided into a plurality of spaces for movement of the position pieces along the taxiway, said game further comprising chance number indicator means for governing the movement of the position pieces along the taxiway spaces.

10. A travel game as set forth in claim 7 wherein said chance means governing entry of the position pieces onto the taxiway comprises a dial spinner divided into a plurality of discrete areas each having a taxiing instruction associated therewith.

* * * * *